United States Patent [19]

Wilson

[11] Patent Number: 4,587,737

[45] Date of Patent: May 13, 1986

[54] HAND PUNCH

[76] Inventor: James M. Wilson, P.O. Box 2984, Durango, Colo. 81301

[21] Appl. No.: 637,067

[22] Filed: Aug. 2, 1984

[51] Int. Cl.[4] ..... B26F 1/32

[52] U.S. Cl. ..... 30/358; 30/361; 83/631

[58] Field of Search ..... 30/358, 361; 83/631

[56] References Cited

U.S. PATENT DOCUMENTS

| | | | |
|---|---|---|---|
| 52,810 | 2/1866 | Allen | 83/631 |
| 236,956 | 1/1881 | Nuebling | 30/358 |
| 1,138,860 | 5/1915 | Gladwin | 83/631 |
| 1,180,357 | 4/1916 | Whitney | 30/361 |
| 2,202,513 | 5/1940 | Benner | 30/361 |
| 3,800,419 | 4/1974 | Hughes | 30/361 |

*Primary Examiner*—Jimmy C. Peters
*Attorney, Agent, or Firm*—Gordon W. Hueschen

[57] ABSTRACT

There is disclosed a hand punch comprising a C-shaped member having a punch and die mounted in the extremities thereof. A rotary head having a threaded member axially disposed therein is mounted for rotation in one extremity of the C and the punch or cutting head is mounted on that member so that, when the rotary head is rotated, the cutting head is advanced into the die. The cutting head has cutting edges adapted to bite into the material to be punched and to hold it against rotation. It is threaded onto the threaded member by a reverse thread so that, once it bites into the material to be punched, the threaded member is held against rotation, whereby rotation of the rotary head drives the punch into the die.

5 Claims, 6 Drawing Figures

HAND PUNCH

BACKGROUND OF THE INVENTION

1. Field of the Invention

The invention relates to a hand punch especially adapted for use by electricians for punching holes in outlet boxes and the like.

2. Prior Art

Outlet boxes and like apparatus used in electrical wiring circuits, while having partially pre-punched holes therein, do not always have such pre-punched holes in the proper places. It is sometimes desirable, therefore for the electrician on the job to be able to cut or otherwise punch holes in the outlet or service boxes in the particular places demanded by the exigencies of the situation.

The punches available for this purpose have been so massive that they have been unsuitable for such use, especially where it is desirable to cut holes in outlet and service boxes which have already been installed.

The present invention avoids the disadvantage of the prior art devices and obtains additional advantages which will become apparent as the description proceeds.

SUMMARY OF THE INVENTION

The invention relates to an improvement in a hand punch comprising a base member, a die member comprising part of said base member, a cutter head complementary with said die member adapted to be driven into said die member in order to punch material disposed on said die member, which comprises a rotary head mounted in said bsae member coaxial with and spaced from said die member, said rotary head having a threaded axial bore and being adapted for in-place rotation relative to said base member; a threaded member complementary with said threaded axial bore adapted to be threaded therein for axial movement when said rotary member is rotated relative thereto; mounting means for mounting said cutter head on said threaded member in position such that axial movement of said threaded member causes said cutter head to move into and out of said die member; and cutting means on said cutter head for cutting into material to be punched, said mounting means and said cutting means cooperating to prevent rotation of said threaded member when said cutting means is engaged with the material to be punched, whereby rotation of said rotary means causes said threaded member and the cutter head mounted thereon to move axially into said die and to effect punching of the material to be punched.

The invention also comprises one or more further features in which said mounting means comprises a reversely threaded bore in said cutter head and a complementary threaded portion at the bottom of said threaded member, whereby the tendency of said threaded member to rotate with said rotary head is counteracted as soon as said cutting means bites into the material to be punched; in which a stop means is disposed between the threaded and reverse threaded portions of said threaded member, whereby when said cutter head is threaded onto the reverse threaded portion thereof, it jams against said stop means; in which and stop means comprises a jam nut adapted to be threaded on said reverse threaded portion; in which said rotary head comprises wrench means whereby it can be rotated, and in which said wrench means is adapted to give with said threaded member sufficient mechanical advantage to effect the desired punching action.

DESCRIPTION OF THE PREFERRED EMBODIMENTS

Figure 3:
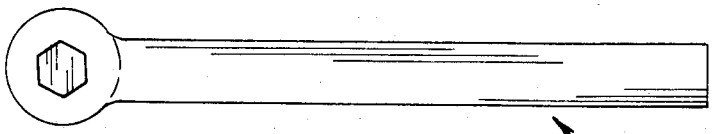
FIG. 3 is a top view.
Figure 1:
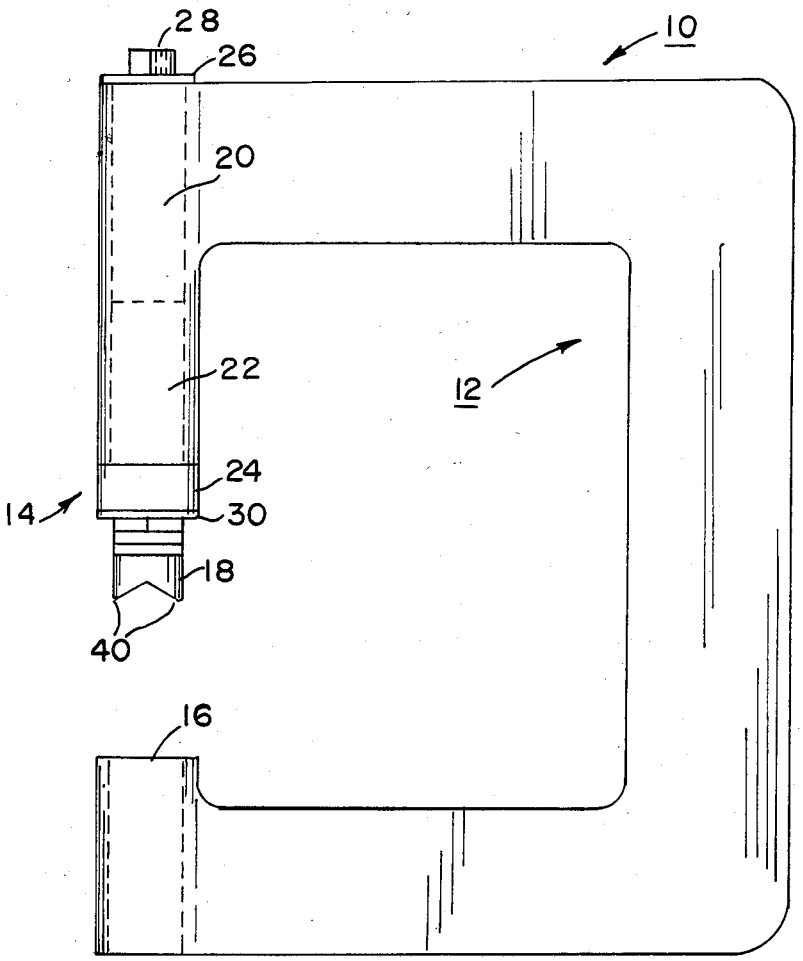
FIG. 1 is a side elevation.
Figure 2:
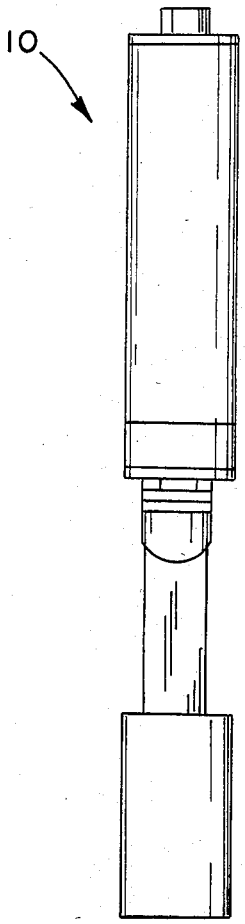
FIG. 2 is an end elevation.

The hand punch 10 illustrated in FIG. 1 has a C-shaped base member 12 having a punching mechanism 14 mounted in one leg of the "C" and a die 16 in the other leg thereof. The die is axially disposed with reference to the punching mechanism so that, when the punch or cutting head 18 is advanced, it moves axially into the die 16 to effect the punching operation.

Figure 4:
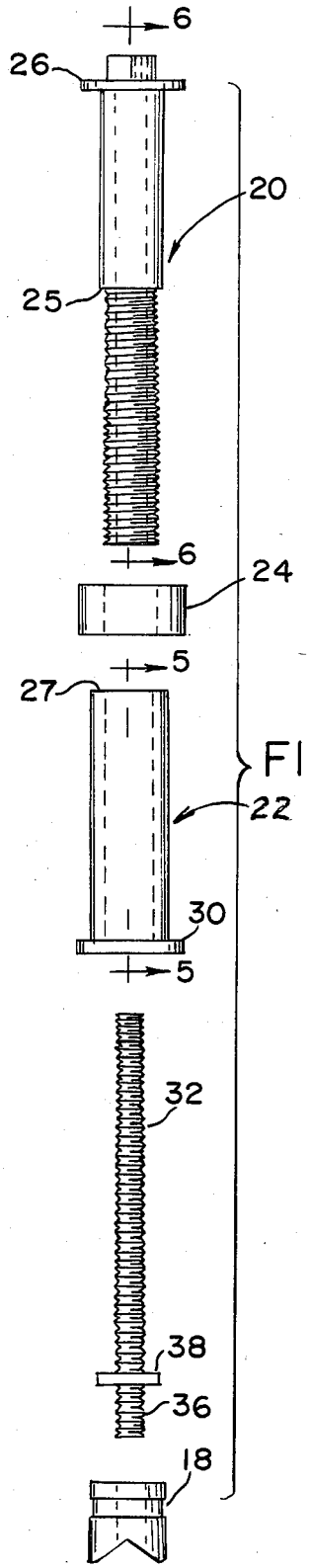
FIG. 4 is an exploded view of the punching mechanism of FIG. 1.
Figure 6:
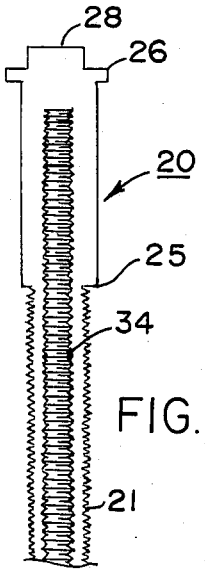
FIG. 6 is a cross section taken along line 6—6 of FIG. 4.
Figure 5:
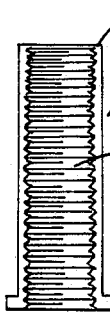
FIG. 5 is a cross section taken along line 5—5 of FIG. 4.

The construction and operation of the punch is best seen in FIGS. 4, 5, and 6. Thus, the member 20 is adapted to be threaded into the member 22 after the thrust bearing 24 has been slipped on the member 22. The member 20 has a flange 26 having an integral nut 28 adapted to be engaged by a wrench to effect rotation. The member 22 has a flange 30 which cooperates with the flange 26 to form a rotary head or assembly and to limit the movement of the same to an in-place rotation. In other words, the rotary assembly is mounted to rotate about its axis but is confined by the flanges 26 and 30 against axial movement.

The member 22 has an internal threaded bore 23 and the member 20 has a complementary external thread 21 adapted to be threaded into the threaded bore 23 of member 22. The member 20 has a shoulder 25 adapted to abut the end 27 of the member 23 in such a position that when the thrust bearing 24 is in place, the member 22 will jam against the shoulder 25 and yet leave enough clearance for rotation of the rotary assembly on the thrust bearing 24.

When the members 20 and 22 are engaged in this position, as shown in FIG. 1, the threaded member 32 is adapted to be threaded into the internal thread 34 of the member 20. The member 32 has a reverse threaded portion 36 adapted to receive the cutter head 18. Cutter head 18 has an axially threaded bore complementary to the reverse threads 34. Between the two threaded portions of the member 32 is a jam nut 38 which, when threaded on the reverse threads 36 forms a stop at the juncture between the two threaded portions. Thus, when the cutter head 18 is threaded on the threads 36, it will jam up against the nut 38. Then when the threaded portion 32 is threaded into the internal threaded bore 34, the assembly will be that as shown in FIG. 1, with the lock or jam nut 38 against the flange 30, which in turn is against the thrust bearing 24.

Now rotation of the rotary member will cause the threaded rod 32 to be expelled or driven out of the assembly, provided the cutter head 18 is held stationary. To this end, the cutter head is provided with cutting head 40 adapted to bite into the material to be cut. Thereafter, any tendency for the threaded member 32 to rotate will be stopped because, if it should rotate with the rotation of the rotary head, the cutter head 18 would be moved away from the jam nut 38 by the reverse threading 36. Accordingly, as soon as the cutting means 40 is engaged in the stock to be punched, continued rotation by means of a wrench on the nut 28 will cause the cutter head 18 to be driven into the die 16 so that the material resting on the die surface will be punched.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. In a hand punch comprising a base member, a die member comprising part of said base member, a cutter head complementary with said die member adapted to be driven into said die member in order to punch material disposed on said die member, the improvement which comprises:

a rotary head mounted in said base member coaxial with and spaced from said die member, said rotry head having a threaded axial bore and being mounted for in-place rotation relative to said base member;

a threaded member complementary with said threaded axial bore adapted to be threaded therein for axial movement when said rotary head is rotated relative thereto;

mounting means for mounting said cutter head on said threaded member in position such that axial movement of said threaded member causes said cutter head to move into and out of said die member;

cutting means on said cutter head for cutting into material to be punched, said mounting means and said cutting means cooperating to prevent rotation of said threaded member when said cutting means is engaged with the material to be punched, whereby rotation of said rotary head causes said threaded member and the cutter head mounted thereon to move axially into said die and to effect punching of the material to be punched; in which said mounting means comprises a reversely threaded bore in said cutter head and a complementary reversely threaded portion at the bottom of said threaded member, whereby the tendency of said threaded member to rotate with said rotary head is counteracted as soon as said cutting means bites into the material to be punched; and in which a stop means is disposed between the threaded and reverse threaded portions of said threaded member, whereby when said cutter head is threaded onto the reverse threaded portion thereof, it jams against said stop means.

2. A hand punch of claim 1, in which said stop means comprises a jam nut adapted to be threaded on said reverse threaded portion.

3. In a hand punch comprising a base member, a die member comprising part of said base member, a cutter head complementary with said die member adapted to be driven into said die member in order to punch material disposed on said die member, the improvement which comprises:

a rotary head mounted in said base member coaxial with and spaced from said die member, said rotary head having a threaded axial bore and being mounted for in-place rotation relative to said base member;

a threaded member complementary with said threaded axial bore adapted to be threaded therein for axial movement when said rotary head is rotated relative thereto;

mounting means for mounting said cutter head on said threaded member in position such that axial movement of said threaded member causes said cutter head to move into and out of said die member;

cutting means on said cutter head for cutting into material to be punched, said mounting means and said cutting means cooperating to prevent rotation of said threaded member when said cutting means is engaged with the material to be punched, whereby rotation of said rotary head causes said threaded member and the cutter head mounted thereon to move axially into said die and to effect punching of the material to be punched; in which said mounting means comprises a reversely threaded bore in said cutter head and a complementary reversely threaded portion at the bottom of said threaded member, whereby the tendency of said threaded member to rotate with said rotary head is counteracted as soon as said cutting means bites into the material to be punched; and in which said rotary head comprises upper and lower flange means to prevent axial movement of said rotary had and to limit the movement thereof to said in-place rotation.

4. A hand punch of claim 3 in which the lower flange is separated from said base member by a thrust bearing.

5. A hand punch of claim 3, in which said rotary member comprises upper and lower parts, one of which is threaded into the other; in which the part which is threaded into the other part has a shoulder adapted to abut the other part and in which the parts, when threaded together, constitute a unitary rotary head, and in which the bottom part is separated from the base member by a thrust bearing to ease rotation of the rotary head during the punching operation.

* * * * *

UNITED STATES PATENT AND TRADEMARK OFFICE

CERTIFICATE OF CORRECTION

PATENT NO. : 4,587,737

DATED : May 13, 1986

INVENTOR(S) : James M. Wilson

It is certified that error appears in the above-identified patent and that said Letters Patent is hereby corrected as shown below:

Col. 1, line 34; "bsae" should read -- base --

Col. 1, line 65; "and" should read -- said --

Col. 2, line 67; "head" should read -- means --

Col. 3, line 25; "rotry" should read -- rotary --

Signed and Sealed this

*Sixteenth* Day of *September 1986*

[SEAL]

*Attest:*

DONALD J. QUIGG

*Attesting Officer*

*Commissioner of Patents and Trademarks*